US007591531B2

(12) United States Patent
Tsuchii et al.

(10) Patent No.: US 7,591,531 B2
(45) Date of Patent: Sep. 22, 2009

(54) LIQUID EJECTION HEAD

(75) Inventors: Ken Tsuchii, Sagamihara (JP); Masataka Sakurai, Kawasaki (JP); Tomoyuki Inoue, Tokyo (JP); Akiko Saito, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/182,670

(22) Filed: Jul. 30, 2008

(65) Prior Publication Data

US 2009/0040273 A1 Feb. 12, 2009

(30) Foreign Application Priority Data

Aug. 7, 2007 (JP) ..... 2007-205909

(51) Int. Cl.
*B41J 2/15* (2006.01)
*B41J 2/145* (2006.01)

(52) U.S. Cl. ..... 347/40; 347/65; 347/85

(58) Field of Classification Search ..... 347/40, 347/15, 56, 65, 71, 84–87
See application file for complete search history.

(56) References Cited

U.S. PATENT DOCUMENTS

| | | | | |
|---|---|---|---|---|
| 4,896,171 | A | 1/1990 | Ito | |
| 6,660,175 | B2 | 12/2003 | Kawamura et al. | |
| 2007/0019044 | A1 * | 1/2007 | Enomoto | 347/71 |

FOREIGN PATENT DOCUMENTS

| | | |
|---|---|---|
| JP | 60-206653 | 10/1985 |

* cited by examiner

*Primary Examiner*—Thinh H Nguyen
(74) *Attorney, Agent, or Firm*—Fitzpatrick, Cella, Harper & Scinto

(57) ABSTRACT

A print head that ejects ink supplied through an ink supply port can prevent the size of satellites from being reduced while inhibiting an increase in resistance to an ink flow. In the print head, ink supply ports are arranged on both sides of a plurality of channels. A predetermined number of ink supply ports are arranged at least one side of the ink channel all over the range of the arrangement of the channels. One side of each of the plurality of channels is connected via the common liquid chamber to the liquid supply port located so as to extend in a direction in which the channels are arranged.

7 Claims, 14 Drawing Sheets

LIQUID EJECTION HEAD

BACKGROUND OF THE INVENTION

1. Field of the Invention

The present invention relates to a liquid ejection head that supplies energy to ejection energy generating elements to provide the energy to the liquid to eject the liquid through ejection ports.

2. Description of the Related Art

In many ink jet printing apparatuses commonly used, a print head as a liquid ejection head has been formed by laminating an orifice plate to a substrate with liquid supply ports and the like formed therein, from the past. The structure of such a print head is shown in FIGS. 11A and 11B. FIG. 11A shows a plan view of a conventional liquid ejection head 501. FIG. 11B shows a sectional view of the conventional liquid ejection head 501 taken along line XIB-XIB in FIG. 11A. In this form of print head, the substrate 503 and the orifice plate 502 are laminated together to form a common liquid chamber 504 in a part of the space between the substrate 503 and the orifice plate 502. A liquid supply port 505 is formed through the substrate 503 so as to communicate with the common liquid chamber 504. Liquid channels 507 extend in communication with the common liquid chamber 504. Pressure chambers 508 are each formed at a portion which is opposite the common liquid chamber 504 in the liquid channels 507. Ejection ports 506 are each formed in the orifice plate 502 so as to communicate with a corresponding one of the pressure chambers 508. Heaters 509 are each located at a position corresponding to one of the ejection ports 506 and serves as an ejection energy generating element that supplies ejection energy to a liquid in the pressure chamber 508. The liquid supplied to the common liquid chamber 504 via the liquid supply port 505 is fed to the pressure chamber 508 via the liquid channels 507. In the pressure chamber 508, the liquid is supplied with energy by the heaters 509 and thus ejected through the ejection ports 506.

In the print head 501, shown in FIGS. 11A and 11B, the liquid is fed in only one direction, from the liquid supply port 505 to the ejection ports 506.

When such a print head 501 is used to eject the liquid for printing, bubbles generated by the heaters 509 grow disproportionately from the pressure chamber 508 toward the liquid supply port 505. Thus, the liquid is ejected while being subjected to a force in this direction. At this time, a trailing part of the ejected liquid is pulled toward the common chamber 504 and torn off. Consequently, these trailing parts, called satellites, are inappropriately small and are prone to become mist floating inside a printer housing instead of impacting a print medium.

Even if the satellites impact the print medium instead of becoming the floating mist, the satellites, having a small mass, are readily affected by air currents; a direction in which the satellites fly is prone to be varied by the air currents. As a result, a position on the print medium at which each satellite impacts the print medium varies, resulting in the high likelihood of density unevenness.

When the satellites are ejected under a force acting toward the common liquid chamber 504, the direction in which the satellites fly is different from a direction in which main droplets fly. Thus, when the print head prints the print medium while performing scan, the manner in which the main droplets and the satellites overlap varies between a forward travel and a backward travel. Images obtained by printing are thus prone to suffer density unevenness.

Measures against the inappropriately small satellite portion are disclosed in Japanese Patent Laid-Open No. 60-206653 (1985) and U.S. Pat. No. 6,660,175. FIG. 12A is a perspective view showing a print head disclosed in Japanese Patent Laid-Open No. 60-206653 (1985); in FIG. 12A, the print head is disassembled into components. FIG. 12B is a sectional view of the periphery of an ejection port that is an essential part of the print head with the assembled components. FIG. 13A is an enlarged broken sectional view of an essential part of a print head disclosed in U.S. Pat. No. 6,660,175. FIG. 13B is a sectional view of a print head shown in FIG. 13A.

In Japanese Patent Laid-Open No. 60-206653 (1985) and U.S. Pat. No. 6,660,175, described above, ink guided to an ink supply port is further guided in an ejection direction. The ink is then guided in a direction orthogonal to the ejection direction. The ink is then provided with heat energy by heaters. Passages through which the ink is fed to ejection ports are formed in a direction from opposite sides of the ejection ports toward the ejection ports. Since the ink to be ejected is fed from the opposite sides of the ejection ports to the ejection ports, a possible one-sided ink flow is inhibited which may affect the growth of bubbles when the ink is ejected. This inhibits a one-sided force from being applied to the ink to be ejected.

Consequently, the bubbles grow and shrink substantially symmetrically with respect to the heater. Thus, the trailing of the ejected ink is prone to be straight, short, and thick. As a result, satellites formed by breakage of the trailing during the process of formation of droplets are prone to be large. In connection with the direction in which the droplets fly, the droplets are ejected exactly along the ejection direction almost orthogonal to an ejection port forming surface. Further, the direction in which the main droplets of the ejected ink fly is exactly along the ejection direction almost orthogonal to an ejection port forming surface, too. Thus, large satellites are generated when the liquid is ejected. Accordingly, the position at which each satellite impacts is unlikely to be affected by air currents, thus stabilizing the ejection direction of the droplets. Therefore, even if printing is performed at a high speed or with small droplets, density unevenness is unlikely to occur. Furthermore, the larger satellites increase a rate at which the satellites reach the print medium, reducing the mist floating in the printer housing instead of impacting the print medium. This reduces the possible contamination of the interior of the printer main body or sheet surfaces caused by the attachment of the floating mist. This makes an electric substrate and an encoder unlikely to become defective. When the satellites and the main droplets are ejected exactly along the direction orthogonal to the ejection port forming surface, it is possible to reduce the variation in the impacting positions of each main droplet and the corresponding satellite between the forward travel and backward travel of a printing operation. Consequently, the density variation is unlikely to occur during the reciprocating printing operation. As a result, density unevenness is unlikely to occur in images obtained on the print medium.

However, according to Japanese Patent Laid-Open No. 60-206653 (1985), the ink stored in a reservoir is further guided in the ink ejection direction through supply pipes. However, the guided ink communicates only with the vicinity of a central portion of ink channels in the direction of the row of ejection ports. Thus, the ink in the common liquid chamber which is positioned in the central portion of the line of ink channels is ejected or sucked by suction recovery. Consequently, the ink stored in the central portion of the ink channels is discharged from the print head instead of remaining in the common liquid chamber. However, the ink in the common liquid chamber which is positioned away from the supply pipes is unlikely to flow even with suction recovery. Thus, the ink stored in this site is prone to remain instead being sucked. Consequently, bubbles are prone to remain in the site and may affect ink ejection. Ejection characteristics are thus likely to vary. This makes it difficult to maintain the appropriate ejection condition of the print head and to stabilize ejection.

According to the method in U.S. Pat. No. 6,660,175, holes are formed in a layer located between the substrate and the orifice plate in the print head. Ink guided to the ink supply port is guided in the ejection direction through the holes. However, since the ink is fed to each of the ejection ports through the corresponding hole, when the ink passes through the hole, the channel forming the hole offers resistance to the ink flow. If the size of the hole is smaller, the resistance increases more. If the length of the channel in the hole is longer, the resistance increases more. The higher resistance reduces a speed at which new ink is refilled (hereinafter referred to as a refill speed) as well as a frequency at which droplets are repeatedly ejected (hereinafter referred to as a driving frequency). This reduces the throughput of a printing apparatus using this print head.

Possible measures against the resistance to the ink flow are to increase the diameter of each of the holes and to reduce the thickness of the layer in which the holes are formed. One of the measures, the increase in the diameter of the hole, enables a reduction in the resistance to the ink flow when the ink passes through the hole. This improves the throughput of the printing apparatus. However, the increased diameter of the hole increases the size of each of the pressure chambers and thus the distance between each ejection port and thus between each ejected droplet. This reduces the density of the ejection ports on the print head and thus a resolution provided by the ejected droplets. The reduced resolution finally reduces the throughput of the printing apparatus. In connection with the measure of reducing the thickness of the layer in which the holes are formed to reduce the length of the channel formed by each hole, an extreme reduction in the thickness of the layer prevents the required strength of the print head from being maintained. Furthermore, the reduced thickness of the layer reduces the amount of heat externally diffused via the layer and thus the amount of heat radiated. Thus, heat generated by the heater cannot be sufficiently released. Consequently, the temperature of the heater portion increases significantly. This prevents the driving frequency from being increased in order to inhibit a rise in the temperature of the print head. Therefore, also in this case, the throughput cannot be improved.

SUMMARY OF THE INVENTION

In view of the above-described circumstances, an object of the present invention is to provide a liquid ejection head that stably ejects droplets at a high driving frequency using a dense nozzle arrangement to allow main droplets and satellites to stably impact a print medium, while preventing bubbles from remaining in a common liquid chamber.

The present invention can provide the liquid ejection head that stably ejects the droplets at the high driving frequency using the dense nozzle arrangement to allow the main droplets and the satellites to stably impact the print medium, while preventing the bubbles from remaining in the common liquid chamber.

Further features of the present invention will become apparent from the following description of exemplary embodiments (with reference to the attached drawings).

DESCRIPTION OF THE EMBODIMENTS

First Embodiment

A first embodiment for carrying out the present invention will be described with reference to the attached drawings.

Figure 1A:
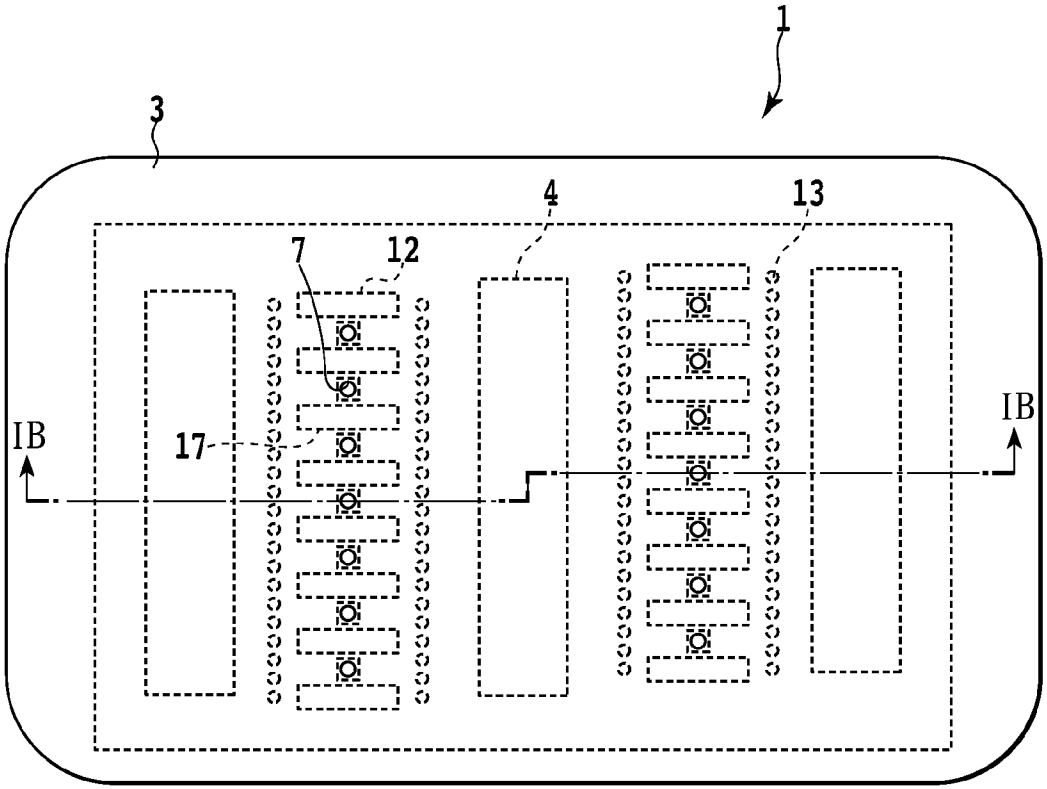
FIG. 1A is a plan view of a print head according to a first embodiment of the present invention.
Figure 1B:
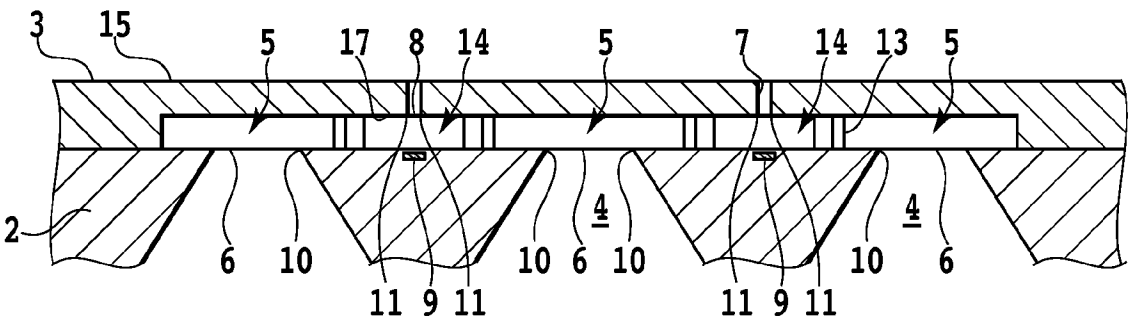
FIG. 1B is a sectional view of the print head taken along line IB-IB in FIG. 1A.

FIG. 1A is a plan view of a print head 1 as a liquid ejection head according to a first embodiment of the present invention. FIG. 1B is a sectional view of the print head taken along line IB-IB in FIG. 1A. In a print head according to the present embodiment, an orifice plate 3 is joined to a substrate 2. FIG. 1A shows a plan view of the orifice plate 3.

Ink supply ports 4 are formed as liquid supply ports in the substrate 2 so as to penetrate the substrate 2 from a back surface to a front surface thereof; ink is introduced into the print head 1 through the ink supply ports 4. To be fed to the interior of each of the ink supply ports 4 and thus into the print head 1, the ink is fed through the ink supply port 4 from the back surface to front surface of the substrate 2. In the present embodiment, the three ink supply ports 4 are formed along line IB-IB. The substrate 2 and the orifice plate 3 are joined together to form a common liquid chamber 5 between the substrate 2 and the orifice plate 3. The ink supply ports 4 communicate with the common liquid chamber 5. A part of the common liquid chambers 5 which communicates with the ink supply port 4 is called an ink supply port communication portion 6. In the present embodiment, the ink supply ports 4, communicating with the common liquid chambers 5, are formed to be long in one direction and are arranged in a plurality of rows. Heaters 9 are arranged in the substrate 2 so that the heaters 9 face the common liquid chambers 5 as ejection energy generating elements that generate energy utilized to eject ink. In the present embodiment, the heaters 9 are electrothermal transducing elements that generate heat in response to electric conduction. To allow ink stored in the common liquid chambers 5 to be ejected to the exterior, ejection ports 7 are formed in the orifice plate 3 opposite the heaters 9 so that the common liquid chambers 5 communicate with the exterior of the print head 1 through the ejection ports 7. The plurality of ejection ports 7 are formed in rows extending in a predetermined direction. In the present embodiment, the plurality of ejection ports 7 are arranged in the same direction as that in which the ink supply ports 4 extend; two rows of the ejection ports 7 are arranged along line IB-IB in FIG. 1A. A part in which the common liquid chambers 5 communicate with the ejection ports 7 is called an ejection port communication portion 8. In the present embodiment, in a cross-section along line IB-IB in FIG. 1A, the two ejection port communication portions 8 are formed between the three ink supply port communication portions 6.

In the present embodiment, the two rows of heaters 9 corresponding to the two rows of the ejection ports 7 are buried and arranged in the substrate 2 opposite the ejection ports 7. Between the adjacent ink supply ports 4, the distance between an edge 10 of one of the ink supply ports 4 and an edge 11 of the ejection port 7 positioned closest to the ink supply ports 4 is equal to the distance between an opposite edge 10 of the other ink supply port 4 and the other edge 11 of the ejection port 7. That is, each ink channel to the adjacent ink supply ports 4 is formed symmetrically with respect to the ejection port 7.

The ink supply ports 4 are arranged on the both sides of a line of the plurality of channels 17. On at least one side of the channels 17, a predetermined number of ink supply ports 4 are arranged all over the range of the arrangement of the channels 17. At least one of the channels 17 connected to a pressure chamber 14 is connected to the ink supply port 4 via the common liquid chamber 5. In the present embodiment, both sides of the channels 17 connected to the pressure chamber 14 are connected to the ink supply port 4 via the common liquid chamber 5. Here, the above-described predetermined number of ink supply ports may be one ink supply port located along the direction in which the ejection ports are arranged or a plurality of ink supply ports into which the one supply port is divided along the arrangement direction of the ejection ports as referred to hereinafter. The ink supply port 4 is located such that the ink supply port 4 communicates with the plurality of channels 17 over the range of the arrangement of the channels 17 in the direction in which the channels 17 are arranged. The ink supply port 4 has a length along the arrangement of the plurality of channels 17. In the present embodiment, the three ink supply ports 4 are arranged, each of which has substantially the same length as that of the plurality of channels 17 arranged. That is, the two rows of channels 17 are sandwiched between the three ink supply ports 4. Since the ink supply ports 4 are thus arranged, ink is fed through the plurality of channels 17 from the both sides of the channels 17.

In the present embodiment, a partition wall 12 is formed between each pair of adjacent ones of the ejection ports 7 arranged in the same direction as that in which the ink supply port 4 extends. Thus, each of the ejection ports 7 and the corresponding heater 9 are arranged in the corresponding one of the channels 17, partitioned by the partition walls 12 in the extension direction of the ink supply port 4. Thus, bubbles generated by the heater 9, described below, expand to efficiently eject droplets. Furthermore, a plurality of cylindrical nozzle filters 13 are arranged on the both sides of the ejection port row in which the ejection ports 7 are arranged. This makes it possible to inhibit foreign matter such as dirt contained in the ink from entering the periphery of the ejection port 7 and the heater 9 to affect the ink ejection. Additionally, the nozzle filters 13 support loads to improve the strength of the print head 1. Here, the pressure chamber 14 is an area surrounded by the substrate 2, the orifice plate 3, and the partition walls 12 and located adjacent to the ejection port 7. The pressure chamber 14 is formed in communication with the common liquid chamber 5 so as to be sandwiched between the ink supply port communication portions 6. The plurality of channels 17 are connected to the pressure chamber 14 so that each of the channels lies opposite the pressure chamber 14. The ink fed to the plurality of channels 17 via the ink supply port 4 is ejected to the exterior in conjunction with driving of the heaters 9.

Now, description will be given of an operation performed by the print head 1 to eject the ink.

When the heater 9 is energized, electric energy is converted into heat. Then, the ink positioned on the heater 9 inside the pressure chamber 14 facing the heater 9 is subjected to film boiling to generate bubbles. When the bubbles are generated inside the pressure chamber 14, pressure is exerted. Thus, the ink positioned inside the pressure chamber 14 and over the heater 9 is pushed toward the ejection port 7 by the pressure generated. The ink is thus ejected through the ejection port 7. The ink ejected through the ejection port 7 impacts the print medium at a predetermined position.

At this time, the ink stored inside the pressure chamber 14 in the common liquid chamber 5 is ejected by driving the heater 9. Ink is then supplied to the interior of the common liquid chamber 5 through the ink supply port 4. The ink from the ink supply port 4 passes through the ink supply port communication portion 6 into the common liquid chamber 5. The ink then travels between the nozzle filters 13 into the pressure chamber 14 and then through the ejection port communication portion 8. The ink is then ejected through the ejection port 7. Here, the ink supply ports 4, through which the ink is supplied to the pressure chamber 14 via the common liquid chamber 5, are formed on the both sides of the ejection port 7. Thus, the ink is fed to the ejection port 7 from the both ink supply ports 4, sandwiching the pressure chamber 14 between the ink supply ports 4, that is, from the both sides of the channel 17. This prevents a possible one-sided flow of the ink fed to the ejection port 7 and enables balanced feeding of the ink from the both ink supply ports 4 to the ejection port 7.

Furthermore, in the present embodiment, between the adjacent ink supply ports 4, the distance between the edge 10 of one of the ink supply ports 4 and the edge 11 of the ejection port 7 positioned closest to the ink supply ports 4 is equal to the distance between the opposite edge 10 of the other ink supply port 4 and the other edge 11 of the ejection port 7. The ink channel to the adjacent ink supply ports 4 is formed symmetrically with respect to the ejection port 7. Consequently, conditions such as a loss of the ink flow which may occur when the ink is supplied to the pressure chamber 14 through the ink supply port 4 are approximately same between the adjacent ink supply ports 4. Thus, when the bubbles grow, the flow rate of the ink fed to the ejection port 7 is substantially the same for the adjacent ink supply ports 4. This inhibits the possible one-sided growth of the bubbles.

Furthermore, even during shrinkage, the bubbles shrink toward the center of the heater 9 in a well-balanced manner.

Since the bubbles grow and shrink in a well-balanced manner rather than one-sidedly, the trailing of the ejected ink is thick and straight. As a result, large satellites are formed as a result of breakage of the trailing during the process of formation of droplets. The satellites fly exactly along an ejection direction orthogonal to an ejection port forming surface. At this time, since the plurality of satellites fly in the same direction, the satellites close to each other combine into a larger satellite. Furthermore, at this time, main droplets similarly fly exactly along the ejection direction, which is almost orthogonal to the ejection port forming surface 15.

The impacting positions of the large satellites as described above are unlikely to be affected by air currents. Even if printing is performed at a high speed or with small droplets, density is unlikely to vary in a printed image. As a result, the image is unlikely to suffer density unevenness. Furthermore, the larger satellites increase a rate at which the satellites reach the print medium, reducing mist floating between the print head and the print medium. This reduces the possible contamination of sheet surfaces caused by the floating mist attached to the interior of the printer main body. This makes an electronic substrate and an encoder unlikely to become defective. Furthermore, when the satellites and the main droplets are ejected exactly along the direction orthogonal to the ejection port forming surface, the difference in impacting position between each main droplet and the corresponding satellite is reduced during the forward and backward travels of the print head in a printing operation. Consequently, the density variation is unlikely to occur during the reciprocating printing operation of the print head.

In U.S. Pat. No. 6,660,175, the ink is fed to the channels for which the ejection ports are formed, through the holes. In contrast, in the present embodiment, the ink is fed to the channels for which the ejection ports are formed, through the ink supply port, having a large opening area. Thus, during the period that the ink is fed to the ejection port and the ink is ejected through the ejection port, only a low resistance is offered to the flow of the ink. This increases the ink refill speed and thus the driving frequency at which the ink is ejected, thus improving the throughput of the printing apparatus.

During suction recovery, each of the ejection ports 7 is capped, and negative pressure is exerted on the ejection port 7 to suck the ink stored inside the pressure chamber 14. In the present embodiment, the length of the ink supply port 4 in a longitudinal direction is substantially equal to that of the row of the arranged ejection ports 7. Thus, during suction recovery, the ink is sucked uniformly through the respective ejection ports 7 to enable an ink flow to occur all over the row of the pressure chambers 14 or the ink supply ports 4. This makes it possible to inhibit the ink having failed to be removed from remaining in a part of the interior of the pressure chamber 14 over the entirety of the common liquid chamber 5. Thus, the suction and the subsequent ink refilling allow the ink to be refreshed all through the common liquid chamber 5, in which bubbles are unlikely to remain. As a result, stable ejection can be stably maintained. In contrast, with the print head in Japanese Patent Laid-Open No. 60-206653 (1985), the ink is fed only from the central portion of the ink channels for which the ejection ports are formed, through the supply pipes. Thus, the flow in the common liquid chamber 5 is nonuniform, and bubbles remain in the common liquid chamber 5. This may disadvantageously make it difficult to maintain the appropriate ejection.

In the present embodiment, the length of the ink supply port 4 is substantially equal to that of the row of the ejection ports 7. However, the length of the ink supply port 4 may be greater than that of the row of the ejection ports 7. Furthermore, in the present embodiment, the three rows of the ink supply ports 4 are arranged along line IB-IB. However, the number of the rows of the ink supply ports 4 formed in the print head 1 is not limited to three but may be at least four or two.

Second Embodiment

Now, a second embodiment will be described with reference to FIGS. 2A and 2B. In the figures, parts of the second embodiment which can be configured similarly to the corresponding ones of the first embodiment are denoted by the same reference numerals as those in the first embodiment. The description of these parts is omitted, and only the differences from the first embodiment will be described below.

Figure 2A:
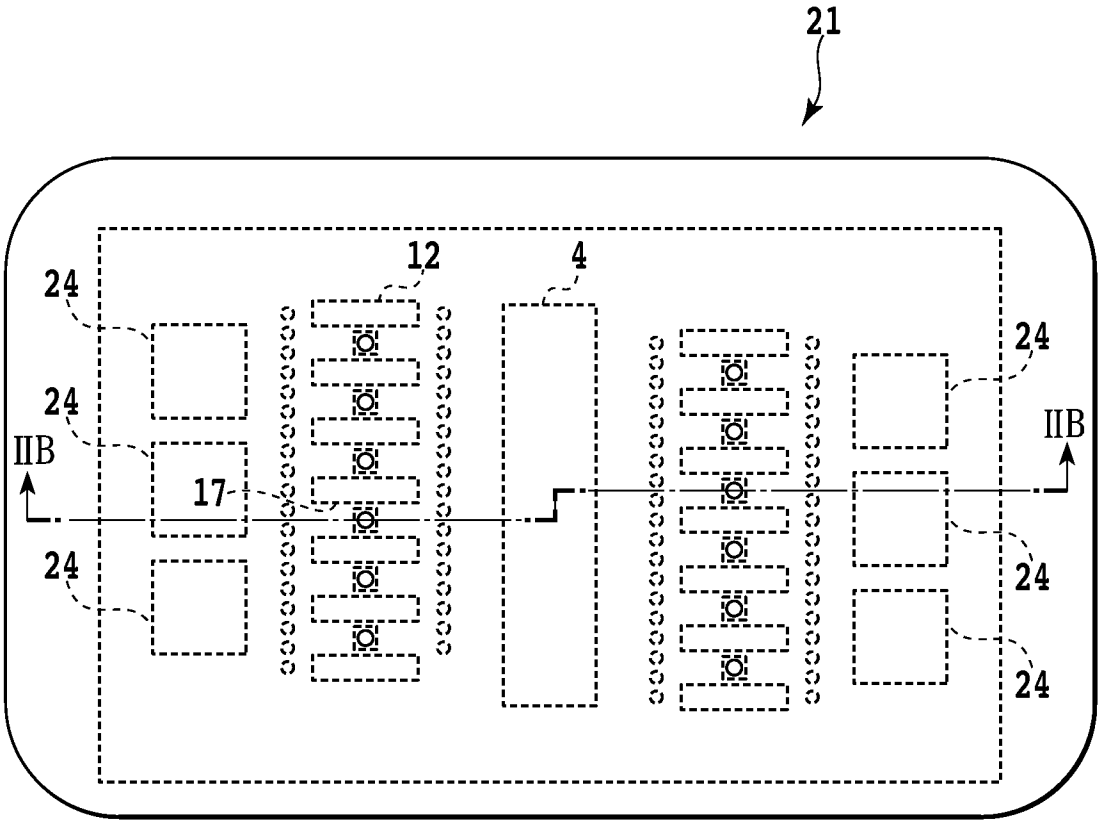
FIG. 2A is a plan view of a print head according to a second embodiment of the present invention.
Figure 2B:
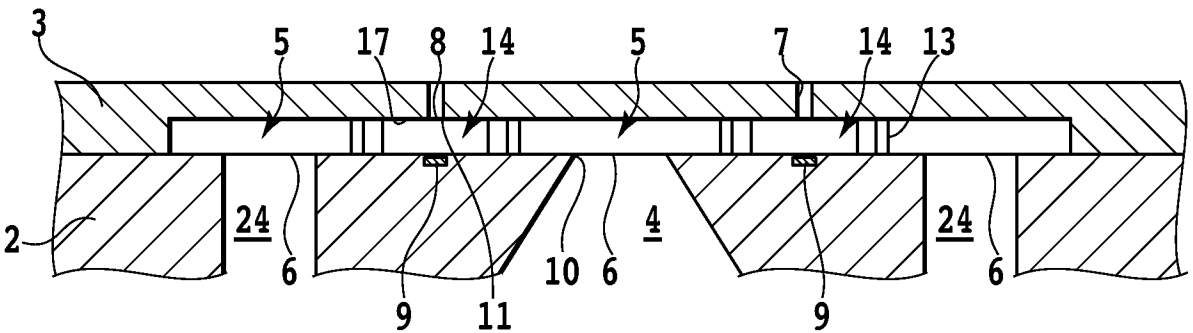
FIG. 2B is a sectional view of the print head taken along line IIB-IIB in FIG. 2A.

FIG. 2A is a plan view of a print head 21 according to the second embodiment. FIG. 2B is a sectional view of the print head 21 taken along line IIB-IIB shown in FIG. 2A.

In the print head 1 according to the first embodiment, the three rows of the ink supply ports all extend in the same direction as that in which the row of the ejection ports extends and are formed continuously all over the length of the ink supply port in the longitudinal direction. In contrast, in the print head 21 according to the second embodiment, a plurality of segmented ink supply ports 24 are formed in the longitudinal direction.

In the first embodiment, two outside ones of the three ink supply ports arranged along line IB-IB in FIG. 1 are continuous all over the length of the ink supply port in the longitudinal direction. Accordingly, wiring through which power is supplied to the heaters 9, arranged in the central row, is unavoidably located between the opening and the heater so as to circumvent the outside ink supply ports 4. Thus, an increase in the number of ejection ports and thus the number of corresponding heaters increases the area occupied by the wiring. This in turn increases the distance between each ejection port and the ink supply port and thus the size of the substrate. As a result, the manufacturing costs of the print head may be increased.

In contrast, in the print head 21 according to the second embodiment, at least one of the ink supply ports arranged on the both sides of the plurality of channels 17 is divided into the plurality of segments in the direction in which the ejection ports 7 are arranged. In the present embodiment, the three segmented ink supply ports 24 are arranged in the direction in which the channels 17 are arranged. In the present embodiment, the predetermined number of the arranged ink supply ports 24 is three. However, the number is not limited to three but may be at least four. In this case, one of the plurality of ink supply ports is formed along the arrangement direction of the ejection ports 7 and along the at least two, plural channels 17.

In the print head 21 according to the present embodiment, the plurality of segmented ink supply ports 24 are arranged in the direction in which the channels are arranged. Thus, the wiring through which power is supplied to the heaters 9 can be passed between the segmented ink supply ports 24. This eliminates the need to circumvent the ink supply ports in order to place the wiring. A space in which the wiring is placed can thus be reduced. This enables a reduction in the distance between each of the heaters and the ink supply port. As a result, the size of the substrate 2 can be reduced, enabling a reduction in the manufacturing costs of the print head 21.

Furthermore, in the print head, part of heat generated by driving the heaters 9, arranged in the substrate 2, is diffused to the exterior of the print head. However, in the print head 1 according to the first embodiment, the heaters 9, arranged at positions corresponding to the respective ejection ports 7, are sandwiched between the longitudinally continuous ink supply ports 4. Thus, heat generated in the central portion of the row of the heaters 9 needs to be diffused around the closer ink supply port 4. Consequently, only a small quantity of heat is diffused in the direction orthogonal to the longitudinal direction of the ink supply port 4. Therefore, while heat generated at the peripheries of the both ends of the row of the heaters 9 is cooled by being diffused in the longitudinal direction of the ink supply port 4, heat generated in the central portion of the row of the heaters 9 is insufficiently diffused. The periphery of the central portion may thus become relatively hot.

In contrast, the print head 21 according to the present embodiment allows heat to be diffused through between the plurality of segmented ink supply ports 24. Heat generated in the central portion of the row of the heaters 9 is also radiated to the exterior of the print head 21 through between the ink supply ports 24 for cooling. This reduces a variation in the temperature distribution on the substrate 2 around the periphery of the heaters 9, the variation depending on the position. The distribution of ejection amount is thus made even with respect to the direction of the row of the ejection ports 7. Thus, the differences of the density between each of the ink ejected from each ejection port are smaller. Consequently, density unevenness is unlikely to occur in an image obtained by printing using the print head 21.

In the description of the present embodiment, the three rows of the ink supply ports are arranged in the print head. However, the print head according to the present invention is not limited to this aspect. Provided that the outside ink supply ports are each divided into a plurality of segments in the direction in which the row of the ejection ports extends, at least three rows of the ink supply ports maybe formed in the print head. Furthermore, in the description of the present embodiment, the ink supply port is divided into three segments. However, the present invention is not limited to this aspect. The number of the segmented ink supply ports may be at least four or two.

Third Embodiment

Now, a third embodiment will be described with reference to FIGS. 3A and 3B. In the figures, parts of the third embodiment which can be configured similarly to the corresponding ones of the first and second embodiments are denoted by the same reference numerals as those in the first and second embodiments. The description of these parts is omitted, and only the differences from the first and second embodiments will be described below.

Figure 3A:
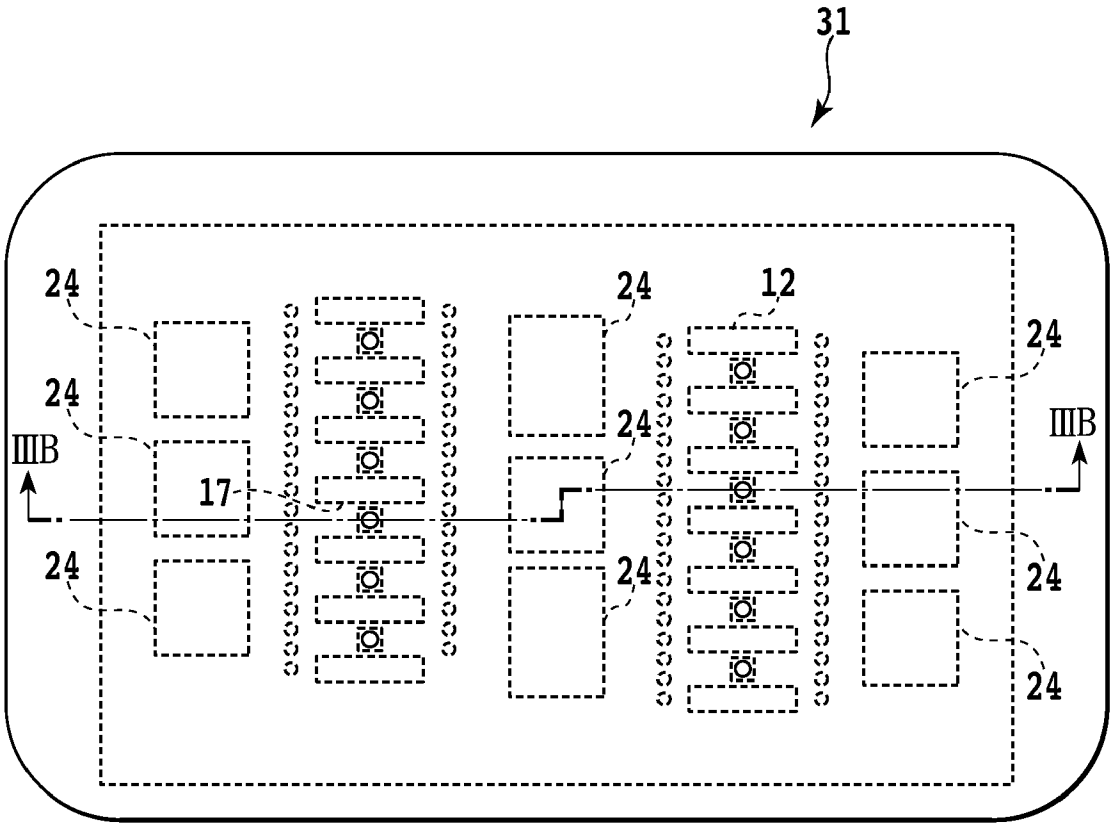
FIG. 3A is a plan view of a print head according to a third embodiment of the present invention.
Figure 3B:
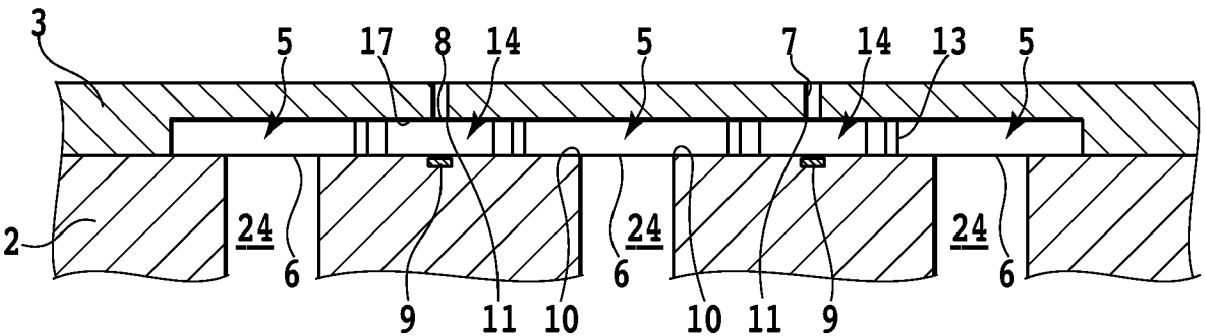
FIG. 3B is a sectional view of the print head taken along line IIIB-IIIB in FIG. 3A.

FIG. 3A is a plan view of a print head 31 according to the third embodiment. FIG. 3B is a sectional view of the print head 31 taken along line IIIB-IIIB shown in FIG. 3A.

In the first embodiment, described above, the three rows of the ink supply ports all extend in the same direction as that in which the row of the ejection ports extends and are formed continuously all over the length of the ink supply port in the longitudinal direction. Furthermore, in the second embodiment, the outside ones of the plurality of ink supply ports are each divided into a plurality of segments, whereas the central ink supply port is formed continuously all over the length of the ink supply port in the longitudinal direction. In contrast, in the print head 31 according to the third embodiment, for all of the plurality of ink supply ports arranged in the direction orthogonal to the direction in which the row of the ejection ports extends, the ink supply port is divided into a plurality of segments in the direction in which the row of the ejection ports extends.

Thus, heat generated in the central portion of the row of the heaters, arranged at the positions corresponding to the respective ejection ports, can be diffused through between the plurality of segmented ink supply ports. The heat can then be radiated to the exterior. This makes it possible to further inhibit a rise in the temperature of the periphery of the central portion of the row of the heaters, thus minimizing a variation in the temperature distribution around the periphery of the row of the heaters. This in turn makes it possible to minimize a variation in ink ejection amount among the ejection ports and thus a variation in the density in an image obtained.

In the description of the present embodiment, the three rows of the segmented ink supply ports are arranged in the print head. However, the print head according to the present invention is not limited to this aspect. The number of the segmented ink supply ports may be at least four or two.

Fourth Embodiment

Now, a fourth embodiment will be described with reference to FIGS. 4A and 4B. In the figures, parts of the fourth embodiment which can be configured similarly to the corresponding ones of the first to third embodiments are denoted by the same reference numerals as those in the first to third embodiments. The description of these parts is omitted, and only the differences from the first to third embodiments will be described below.

Figure 4A:
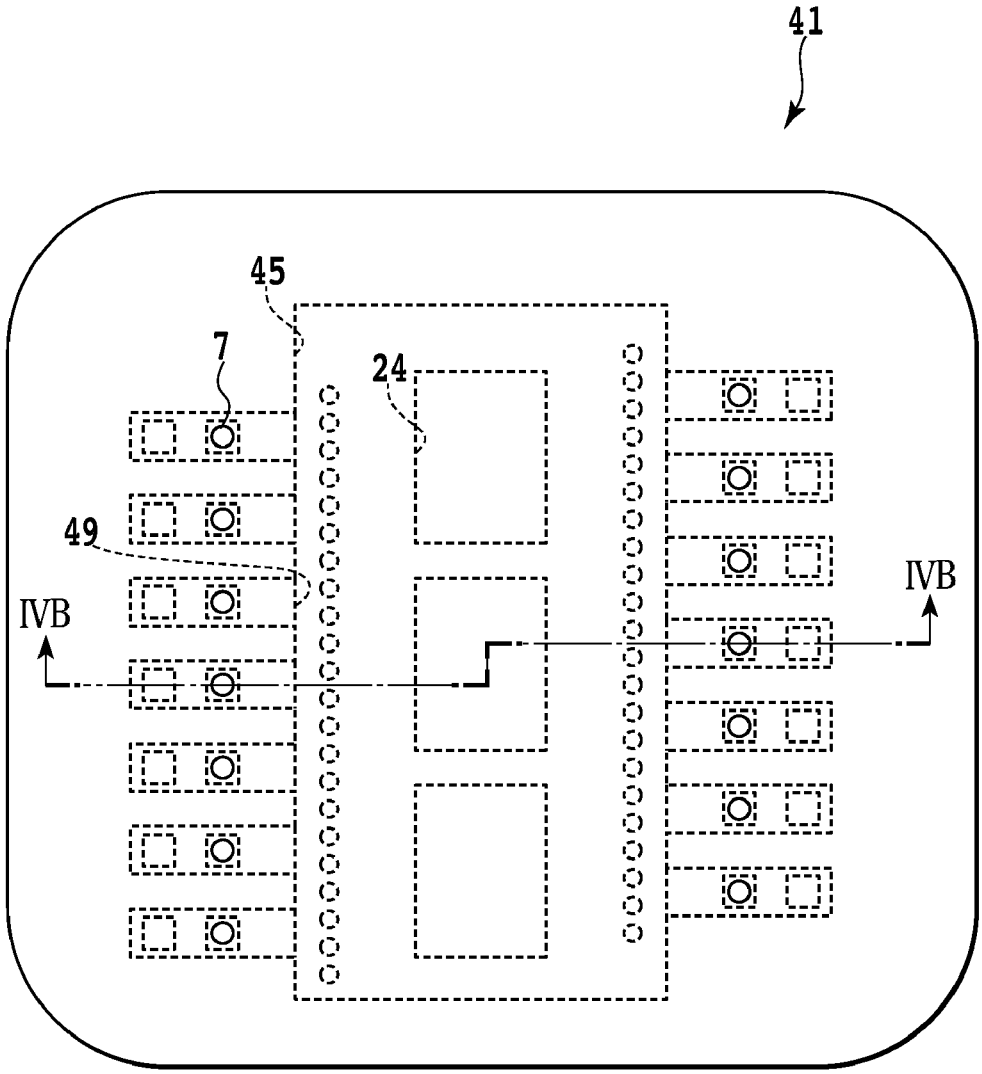
FIG. 4A is a plan view of a print head according to a fourth embodiment of the present invention.
Figure 4B:
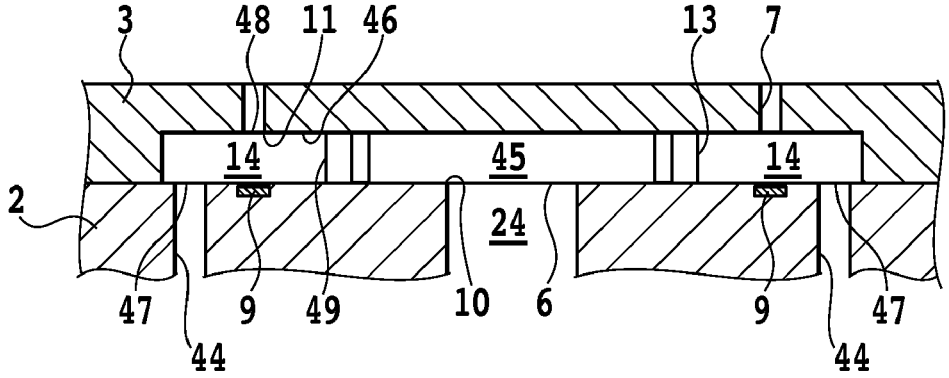
FIG. 4B is a sectional view of the print head taken along line IVB-IVB in FIG. 4A.

FIG. 4A is a plan view of a print head 41 according to the fourth embodiment. FIG. 4B is a sectional view of the print head 41 taken along line IVB-IVB shown in FIG. 4A.

In the first to third embodiments, described above, the relatively large ink supply ports are formed substantially all over the side of the print head which extends in the direction in which the rows of the ejection ports are arranged. In contrast, in the print head 41 according to the present embodiment, channels 46 are formed so as to extend outward from the common liquid chamber 45. One of the ink supply ports arranged on the both sides of the plurality of channels 46, that is, the ink supply port 24 is formed so as to communicate with the common liquid chamber 45. For the ink supply ports arranged on the both sides of the plurality of channels 46, the ink supply ports arranged on one side of the channels 46, that is, the ink supply ports 24 are formed so as to communicate with the common liquid chamber 45. For the ink supply ports arranged on the both sides of the plurality of channels 46, the ink supply ports arranged on the other side of the channels 46, that is, intra-channel ink supply ports 44, are each formed so as to communicate with the corresponding channel at an end thereof.

In the present embodiment, the channels 46 are formed in communication with the common liquid chamber 45 so as to extend in the direction orthogonal to the arrangement direction of the ink supply ports. The intra-channel ink supply ports 44 are formed so as to communicate with the respective channels 46. Here, a portion in which the common liquid chamber 45 communicates with each of the ink channels 17 is called a channel communication portion 49. A portion in which each of the intra-channel ink supply ports 44 communicates with the corresponding channel 46 is called an intra-channel ink supply port communication portion 47. In the present embodiment, the ejection ports 7 are each formed in the space between the corresponding channel communication portion 49 and the corresponding intra-channel supply port communication portion 47, so as to communicate with the corresponding channel 46. A portion in which the channel 46 communicates with the ejection port 7 is called an ejection port communication portion 48. In the present embodiment, the intra-channel ink supply port 44 is formed so as to communicate with the channel 46 on an outer side thereof and almost at an end thereof. The ejection port 7 communicates with the channel 46 inside the outside end of the channel 46.

The print head 41 according to the present embodiment is structured such that bubbles generated by driving the heaters 9 grow in a well-balanced manner in the both directions with respect to the direction in which the ink supply ports extend. Furthermore, the opening area of the intra-channel supply port 44, communicating with the channel 46, is formed to be narrow. Consequently, the area of the substrate 2 can be reduced with the quality of printed images maintained. This enables a corresponding reduction in the manufacturing costs of the print head 41.

In the present embodiment, the ink is supplied through the intra-channel ink supply ports 44, communicating with the respective channels 46, and through the central ink supply ports 24. However, the two intra-channel ink supply ports 44 maybe formed inside the channel 46 so as to communicate with each other, with the ejection ports formed between the intra-channel ink supply ports 44. However, if the ink is ejected through the ejection ports 7 sandwiched between the two intra-channel ink supply ports 47, communicating with the channels 46, as is the case with the configuration in U.S. Pat. No. 6,660,175, the opening area of each of the intra-channel ink supply ports 47 needs to be reduced in order to provide a high-resolution nozzle arrangement. In this case, to be fed to the pressure chamber 14 inside the channel 46, the ink needs to be fed through the intra-channel ink supply port 47, having the small opening area and offering a high resistance. This reduces the refill speed at which after ink ejection, new ink is refilled into the pressure chamber. This in turn reduces the driving frequency and thus the throughput of the print head 41. On the other hand, when the opening area of the ink supply port 44 is increased to reduce the flow resistance, the nozzle resolution unavoidably needs to be reduced. Thus, it is difficult to achieve both increased density of nozzle and increased refill frequency.

Thus, it is preferable that instead of both communicating with the channels 46, the ink supply ports formed to sandwich the ejection ports be configured such that one of the ink supply ports communicates with the channels 46, while the other is relatively large and is formed along the plurality of channels 46 so as to communicate with the common liquid channel. This configuration allows nozzles to be densely arranged while preventing a possible increase in the resistance of the channels, through which new ink flows for refilling, making it possible to prevent a possible reduction in refill speed.

Fifth Embodiment

Now, a fifth embodiment will be described with reference to FIGS. 5A and 5B. In the figures, parts of the fifth embodiment which can be configured similarly to the corresponding ones of the first to fourth embodiments are denoted by the same reference numerals as those in the first to fourth embodiments. The description of these parts is omitted, and only the differences from the first to fourth embodiments will be described below.

Figure 5A:
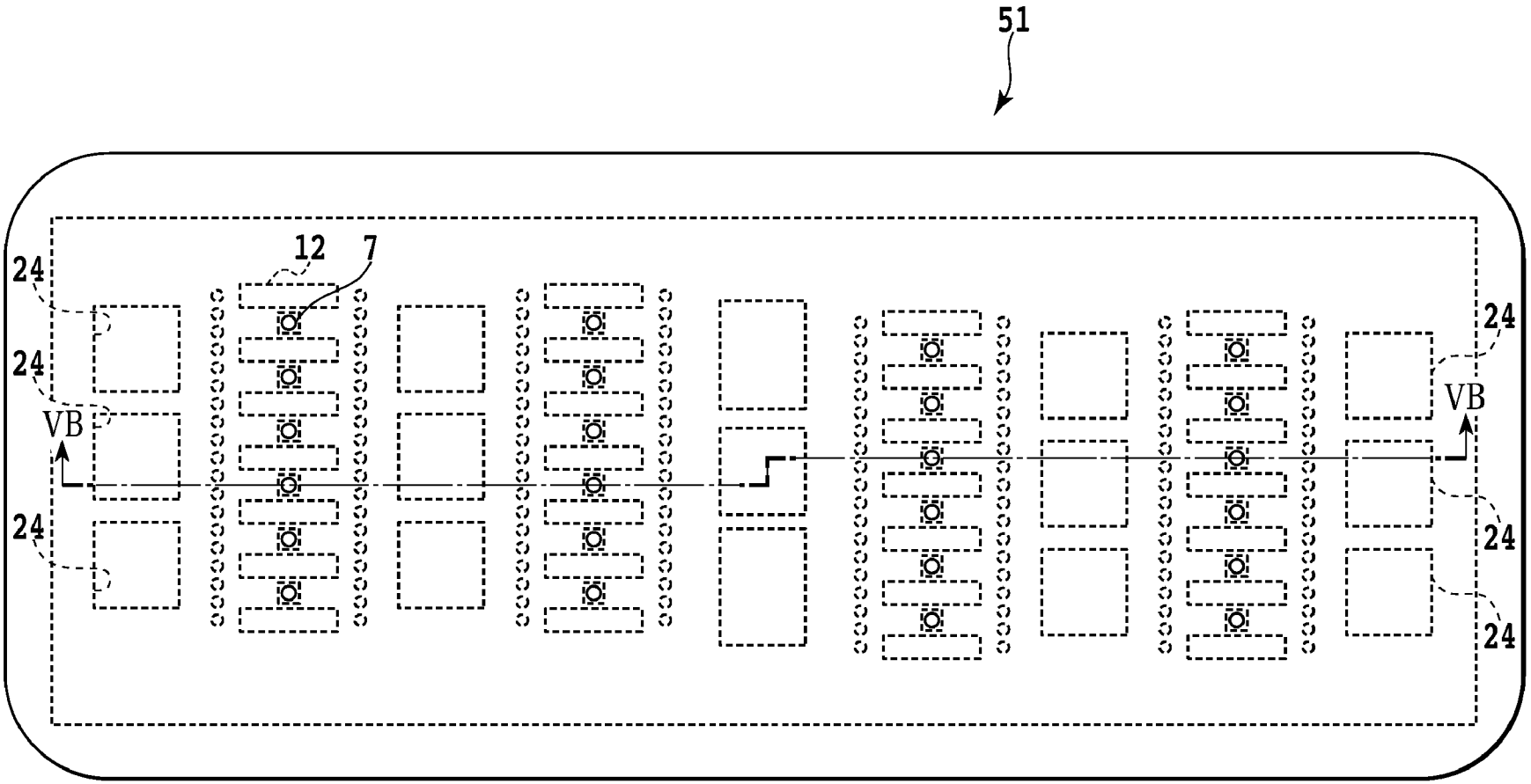
FIG. 5A is a plan view of a print head according to a fifth embodiment of the present invention.
Figure 5B:
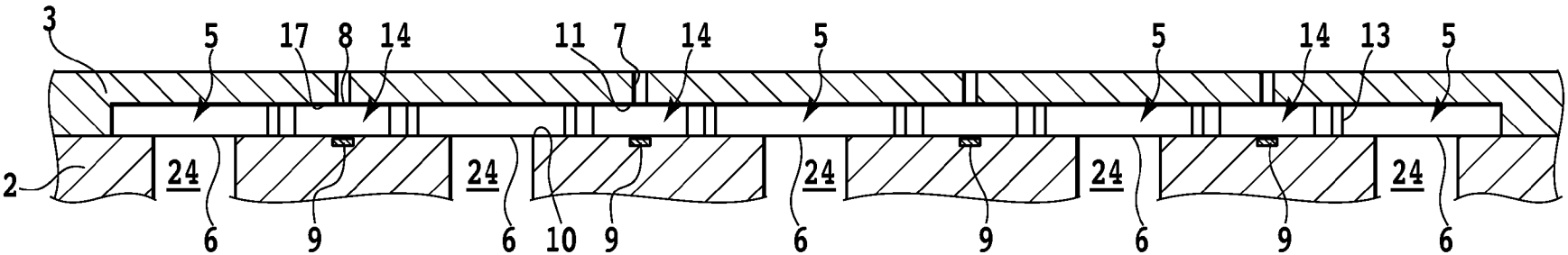
FIG. 5B is a sectional view of the print head taken along line VB-VB in FIG. 5A.

FIG. 5A is a plan view of a print head 51 according to the fifth embodiment. FIG. 5B is a sectional view of the print head 51 taken along line VB-VB shown in FIG. 5A.

In the above description of the third embodiment, the three rows of the plurality of segmented ink supply ports 4 are formed in the direction in which the rows of the ejection ports extend. In the print head 51 according to the fifth embodiment, in addition to the three rows of the ink supply ports 4, the row of the segmented ink supply ports 24 is formed on each of the both sides of the ink supply ports 4 so as to communicate with the common liquid chamber 5. The ejection ports 7 are arranged between the rows of the ink supply ports 24, with the heaters 9 arranged at the positions corresponding to the respective ejection ports 7. The outermost ejection ports 7 in the print head 51 according to the present embodiment are formed to have a smaller diameter so as to provide a smaller ejection amount than the ejection ports 7 formed inside the outermost ejection ports 7. Since the ejection ports are formed to provide the different ejection amounts, the amount of droplets ejected during printing can be adjusted. High-quality images can thus be printed. Furthermore, printing can be performed at a higher speed.

In the print head according to the present invention, the number of the rows of the ink supply ports is not limited to three but may be at least four. Furthermore, the number of the rows of the ejection ports formed between the rows of the ink supply ports need not be two but may be at least three. Additionally, the size of the ejection ports need not be uniform but may vary depending on the desired ejection amount.

Sixth Embodiment

Now, a sixth embodiment will be described with reference to FIGS. 6A and 6B. In the figures, parts of the sixth embodiment which can be configured similarly to the corresponding ones of the first to fifth embodiments are denoted by the same reference numerals as those in the first to fifth embodiments. The description of these parts is omitted, and only the differences from the first to fifth embodiments will be described below.

Figure 6A:
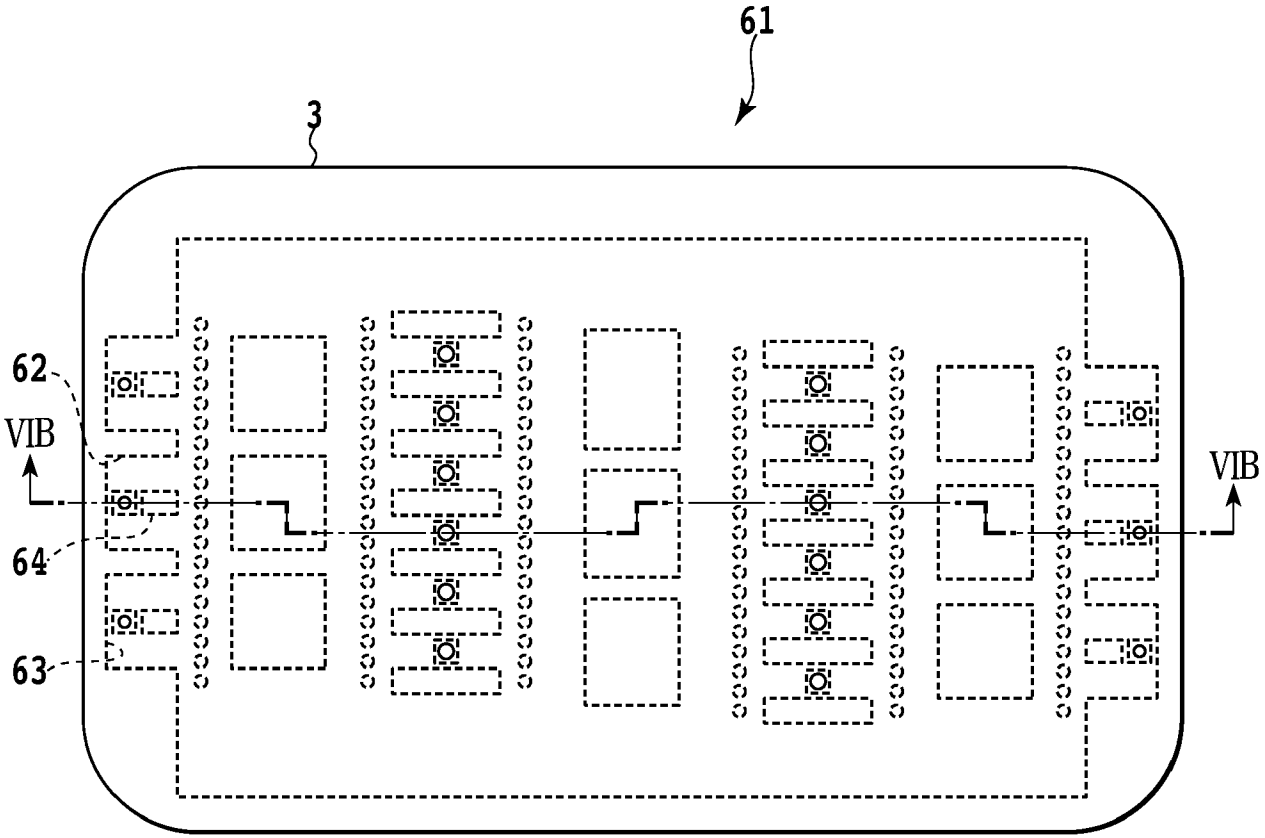
FIG. 6A is a plan view of a print head according to a sixth embodiment of the present invention.
Figure 6B:
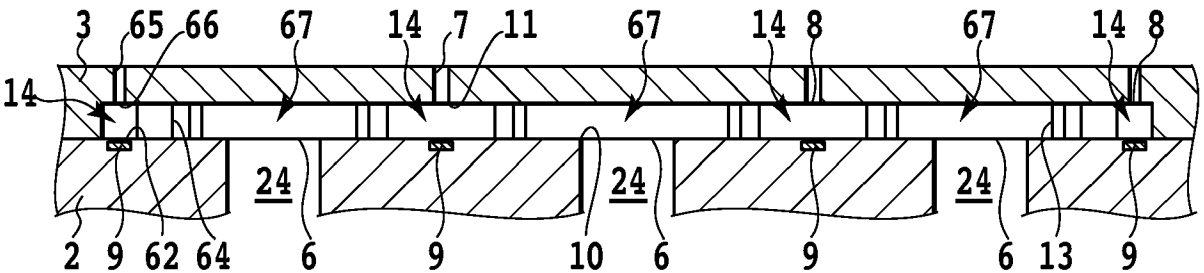
FIG. 6B is a sectional view of the print head taken along line VIB-VIB in FIG. 6A.

FIG. 6A is a plan view of a print head 61 according to the sixth embodiment. FIG. 6B is a sectional view of the print head 61 taken along line VIB-VIB shown in FIG. 6A.

In the above description of the third embodiment, the three rows of the plurality of segmented ink supply ports 4 are formed in the direction in which the rows of the ejection ports extend. In the print head 61 according to the sixth embodiment, in addition to the ink supply ports 4, ink passages 62 are formed in a part of the outside of a common liquid chamber 67 as liquid passages such that each of the ink passages 62 extends outward from the common liquid chamber 67 and then back to the common liquid chamber 67 to communicate with the common liquid chamber 67. An ejection port 65 is formed in a part of each of the ink passages 62 so as to form an ejection port communication portion 66 in which the ink passage 62 and the corresponding ejection port 65 communicate with each other. The heater 9 is located at a position corresponding to the ejection port 65, and the pressure chamber 14 is formed over the heater 9. In the present embodiment, the ink passage has a recess portion 63 formed in a part of an outer edge of the common liquid chamber 67; the recess portion 63 corresponds to an outward projecting portion of the common liquid chamber 67. A partition wall 64 is located inside the recess portion 63 to form the ink passage 62 inside the recess portion 63.

The print head 61 according to the present embodiment eliminates the need to form the ink supply port outside the pressure chambers 14 in order to prevent the growth of bubbles from being limited. This in turn eliminates the need for a corresponding increase in the size of the print head 61. The present embodiment can thus inhibit an increase in the size of the substrate in the print head 61 and thus in the manufacturing costs of the print head 61.

Furthermore, in the print head 61 according to the present embodiment, the outermost ejection ports 65, formed in the respective ink passages 62, are formed to have a smaller diameter than the ejection ports 7 in the inside ejection port rows positioned between the plurality of the ink supply ports 4; the outside ejection ports 65 are formed to provide a smaller ejection amount than the ejection ports 7. The amount of droplets ejected during printing can thus be adjusted, allowing high-quality images to be printed. Furthermore, printing can be performed at a higher speed.

Seventh Embodiment

Now, a seventh embodiment will be described with reference to FIGS. 7A and 7B. In the figures, parts of the seventh embodiment which can be configured similarly to the corresponding ones of the first to sixth embodiments are denoted by the same reference numerals as those in the first to sixth embodiments. The description of these parts is omitted, and only the differences from the first to sixth embodiments will be described below.

Figure 7A:
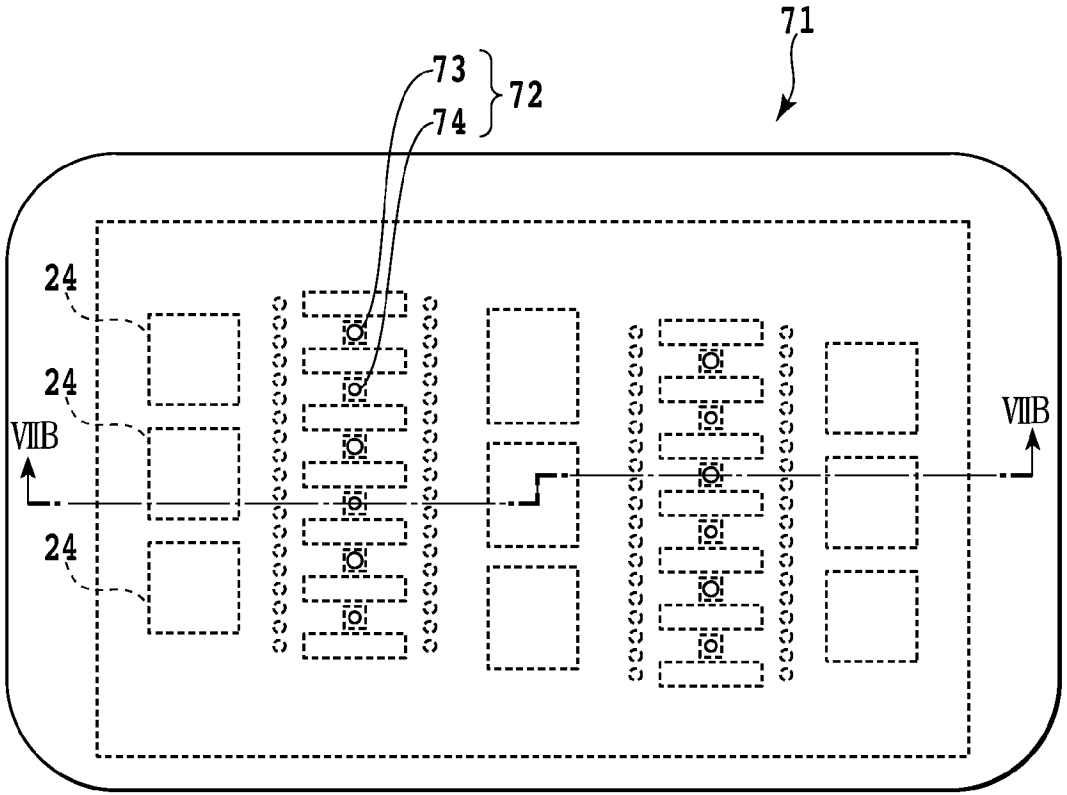
FIG. 7A is a plan view of a print head according to a seventh embodiment of the present invention.
Figure 7B:
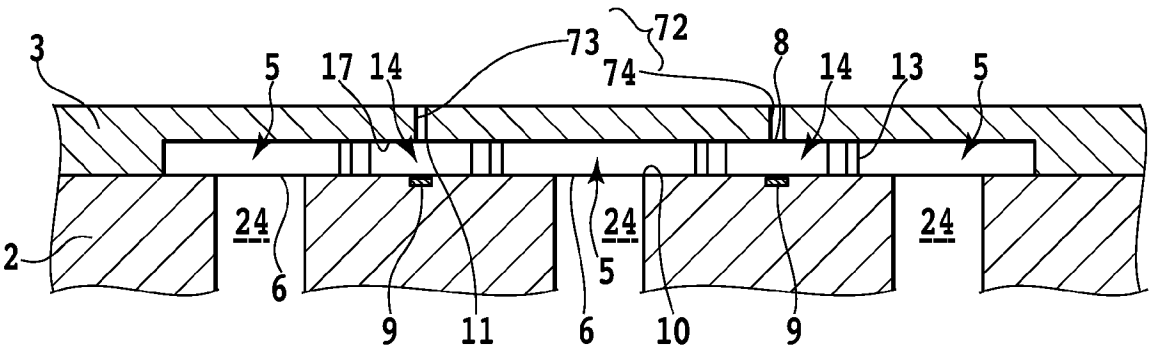
FIG. 7B is a sectional view of the print head taken along line VIIB-VIIB in FIG. 7A.

FIG. 7A is a plan view of a print head 71 according to the seventh embodiment. FIG. 7B is a sectional view of the print head 71 taken along line VIIB-VIIB shown in FIG. 7A.

In the above description of the third embodiment, the three rows of the plurality of segmented ink supply ports 4 are formed in the direction in which the rows of the ejection ports extend. Additionally, in the print head 71 according to the seventh embodiment, a plurality of ejection ports 72 are each formed to have a greater-ejection-amount ejection port 73 and a smaller-ejection-amount ejection port 74 which provide different ejection amounts; the smaller-ejection-amount ejection port 74 is formed to eject a smaller amount of liquid than the greater-ejection-amount ejection port 73. The greater-ejection-amount ejection ports 73 and the smaller-ejection-amount ejection ports 74 are alternately arranged in the direction in which the rows extend. Thus, with the print head 71 according to the present embodiment, the amount of droplets ejected during printing can be adjusted without the need to increase the number of ejection ports. This allows high-quality images to be inexpensively printed without the need to increase the size of the print head. Furthermore, printing can be performed at a higher speed.

Eighth Embodiment

Now, an eighth embodiment will be described with reference to FIGS. 8A and 8B. In the figures, parts of the eighth embodiment which can be configured similarly to the corresponding ones of the first to seventh embodiments are denoted by the same reference numerals as those in the first to seventh embodiments. The description of these parts is omitted, and only the differences from the first to seventh embodiments will be described below.

Figure 8A:
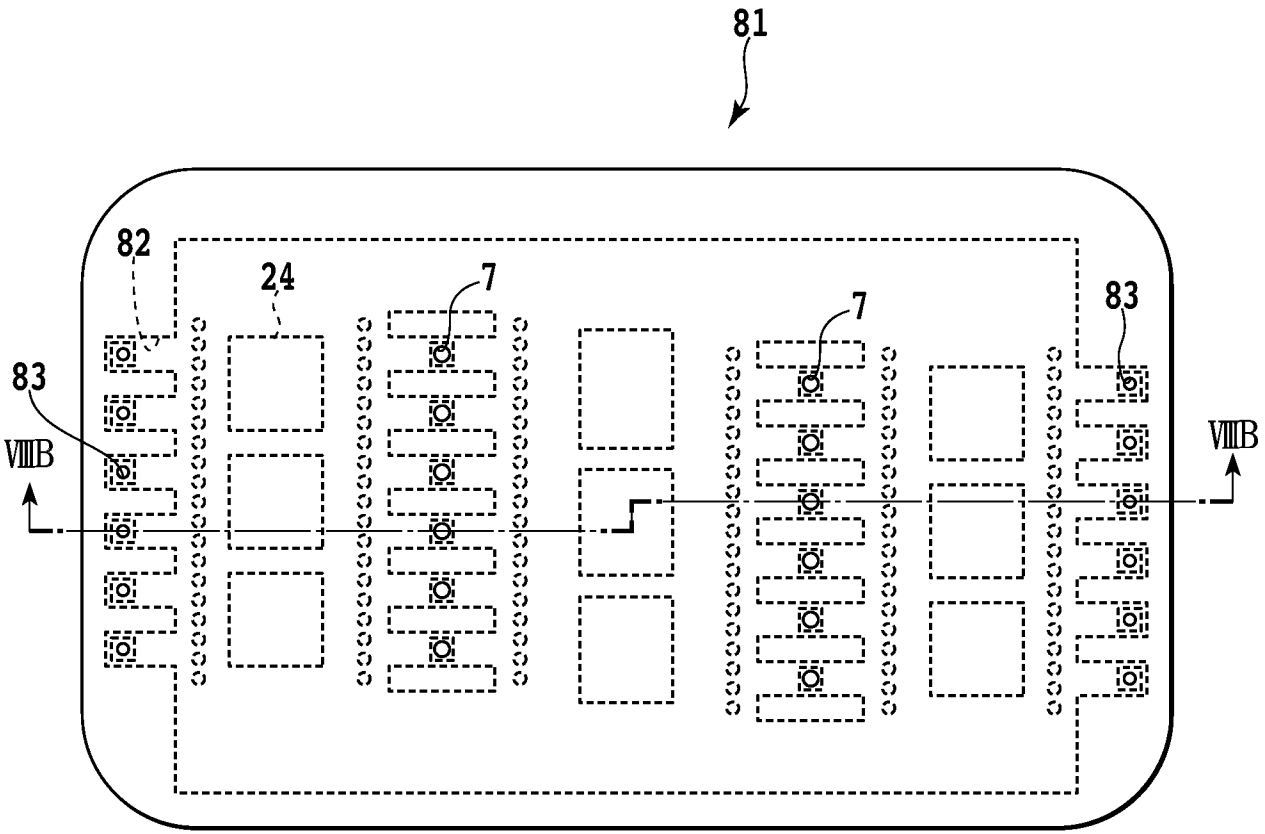
FIG. 8A is a plan view of a print head according to an eighth embodiment of the present invention.
Figure 8B:
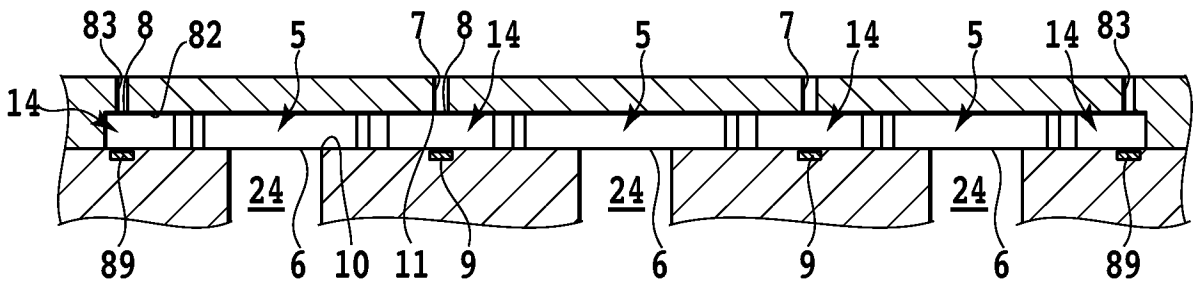
FIG. 8B is a sectional view of the print head taken along line VIIIB-VIIIB in FIG. 8A.

FIG. 8A is a plan view of a print head 81 according to the eighth embodiment. FIG. 8B is a sectional view of the print head 81 taken along line VIIIB-VIIIB shown in FIG. 8A.

In the above description of the third embodiment, the three rows of the plurality of segmented ink supply ports 4 are formed in the direction in which the rows of the ejection ports extend. Additionally, in the print head 81 according to the eighth embodiment, ink passages 82 are formed between the orifice plate 3 and the substrate 2 at an outer edge of the substrate 2 as liquid passages, so as to extend from the common liquid chamber 5 toward the outer periphery of the substrate 2. Intra-ink-passage ejection ports 83 are each formed in the orifice plate as an intra-liquid-passage ejection port so as to communicate with the corresponding ink channel 82 at a position close to an outside end of the ink passage 82. Intra-ink-passage heaters 89 are arranged in the substrate 2 as intra-liquid-passage ejection energy generating elements so as to face the respective intra-ink-passage ejection ports 83.

In the present embodiment, each of the ink channels 82 is formed so as to project outward from the common liquid chamber 5, and each of the intra-ink-passage ejection ports 83 is formed at the outermost end of the corresponding ink channel 82. The intra-ink-passage heaters 89 are located at positions corresponding to the respective intra-ink-channel ejection ports 83 so as to form each of the pressure chambers 14 at an outermost end of the corresponding ink passage 82. Since each of the pressure chambers 14, formed in an outer peripheral portion of the substrate 2, is located at the outermost end of the corresponding ink passage 82, the pressure chamber 14 is surrounded in three directions except for direction from the pressure chamber 14 to a connecting portion between the ink passage 82 and the pressure chamber 14 by a wall surface defining the corresponding ink passage 82. Each of the intra-ink-passage ejection ports 83 is formed in an outermost area of the corresponding ink passage 82 as the smaller-ejection-amount ejection port; the intra-ink-passage ejection ports 83 have the smaller diameter than the inside ejection ports 7, sandwiched between the ink supply ports 24. In this manner, the amount of ink ejected through each of the intra-ink-passage ejection ports 83, formed in the corresponding ink passage 82, is set smaller than that of ink ejected through each of the inside ejection ports 7, sandwiched between the ink supply ports.

According to the present invention, the ink channels are formed in the area between each of the portions in which the common liquid chamber 5 communicates with the ink supply ports so that the communication between the common liquid chamber 5 and the ejection ports allows the ink to be ejected without limiting the growth of bubbles generated by the heaters. However, in the present embodiment, since the outside intra-ink-passage ejection ports 83 are each formed at the outermost end of the corresponding ink passage 82, the growth of the bubbles generated by the heater may be limited by the wall surface of the outside end of the ink passage 82. However, the intra-ink-passage ejection port 83, formed to have the smaller diameter and set to provide the smaller ejection amount, is unlikely to affect droplets in connection with the limitation of the growth of the bubbles by the wall surface than the ejection port 7 set to provide relatively greater ejection amount and arranged inward of the common liquid chamber 5. Thus, since the ejection port with the smaller ejection amount is unlikely to affect limitation of the growth of the bubbles, the heater and the ejection port may be formed at the end of the ink passage. The ejection port may be formed between the ink supply ports or at the end of the ink channel depending on the amount of ink ejected through the ejection port.

In the present embodiment, the ejection ports with the relatively small ejection amount are each formed at the end of the corresponding ink passage 82. Thus, no ink supply port is formed outside the outermost ejection ports. This makes it possible to inhibit an increase in the size of the substrate 2 and to reduce the manufacturing costs of the print head.

Ninth Embodiment

Now, a ninth embodiment will be described with reference to FIGS. 9A and 9B. In the figures, parts of the ninth embodiment which can be configured similarly to the corresponding ones of the first to eighth embodiments are denoted by the same reference numerals as those in the first to eighth embodiments. The description of these parts is omitted, and only the differences from the first to eighth embodiments will be described below.

Figure 9A:
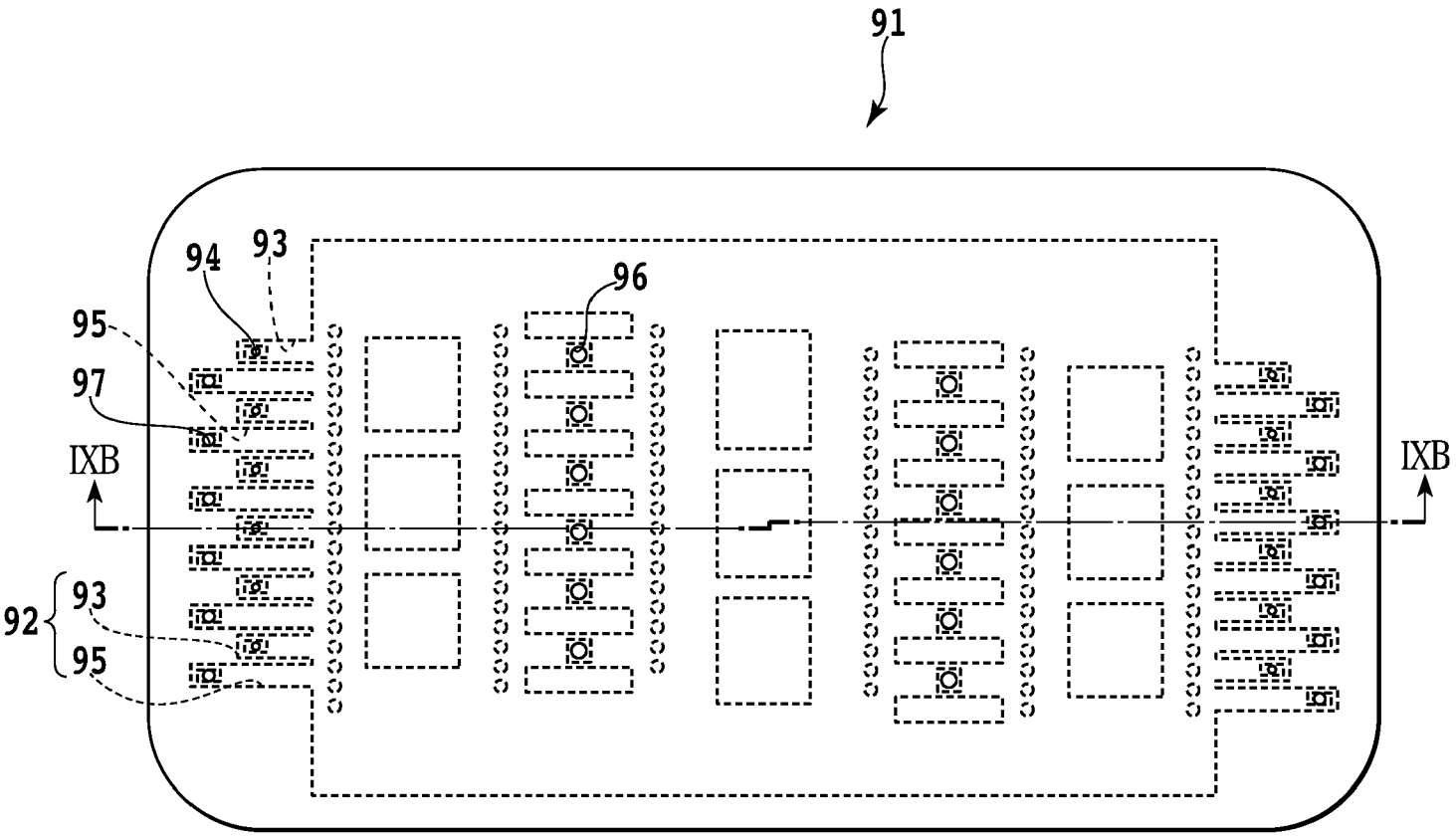
FIG. 9A is a plan view of a print head according to a ninth embodiment of the present invention.
Figure 9B:
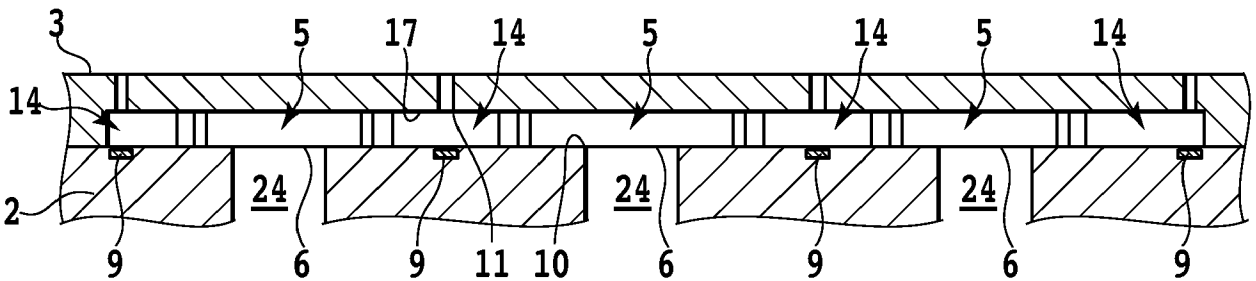
FIG. 9B is a sectional view of the print head taken along line IXB-IXB in FIG. 9A.

FIG. 9A is a plan view of a print head 91 according to the ninth embodiment. FIG. 9B is a sectional view of the print head 91 taken along line IXB-IXB shown in FIG. 9A.

In the print head according to the eighth embodiment, the ink passages are formed so as to project outward from the common liquid chamber 5, each of the ink passages has the same length and each of the ejection ports is formed at the outside end of the corresponding ink passage. Instead, the print head 91 according to the present embodiment has plural types of intra-ink-passage ejection ports with different amounts of ink ejected. Specifically, a plurality of ink passages 92 projecting outward from the common liquid chamber 5 and having different lengths are formed so that the row of the ejection ports is staggered. An ejection port is formed at an outermost end of each of the ink channels 92. Smaller-ejection-amount ejection ports 94 having the smallest diameter in the print head 91 are each formed at an outermost end of a corresponding shorter ink passage 93 projecting by a smaller length. Medium-ejection-amount ejection ports 97 are each formed at an outermost end of a corresponding longer ink channel 95 projecting by a larger length; the medium-ejection-amount ejection port 97 has a diameter larger than that of the smaller-ejection-amount ejection port 94 and smaller than that of larger-ejection-amount ejection ports 96 formed between the inside ink supply ports 24. Since the plural types of ejection ports with the different ink ejection amounts are thus formed, the amount of droplets ejected during printing can be more precisely adjusted. Higher-quality images can thus be printed. Furthermore, printing can be performed at a higher speed.

Furthermore, on the basis of the staggered arrangement, the ejection ports with the plural types of ejection amounts are densely formed. Thus, the quality of images can be improved without the need to increase the size of the substrate 2. This makes it possible to inhibit an increase in the manufacturing costs of the print head.

In the present embodiment, the three-types of ejection ports with the different diameters are formed according to the amount of ink ejected through the ejection ports. The number of the ejection port types is not limited to three but may be at least four. Furthermore, the length of the ink channels may be correspondingly varied.

Tenth Embodiment

Now, a tenth embodiment will be described with reference to FIGS. 10A and 10B. In the figures, parts of the tenth embodiment which can be configured similarly to the corresponding ones of the first to ninth embodiments are denoted by the same reference numerals as those in the first to ninth embodiments. The description of these parts is omitted, and only the differences from the first to ninth embodiments will be described below.

Figure 10A:
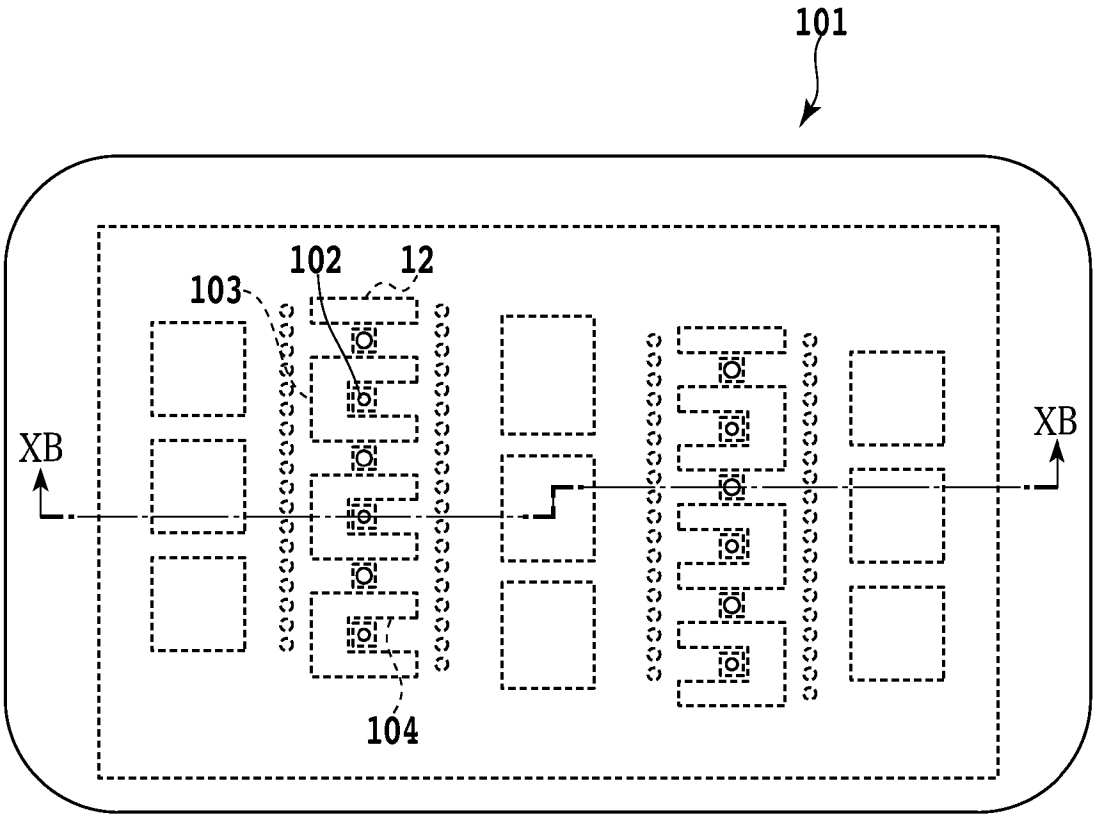
FIG. 10A is a plan view of a print head according to a tenth embodiment of the present invention.
Figure 10B:
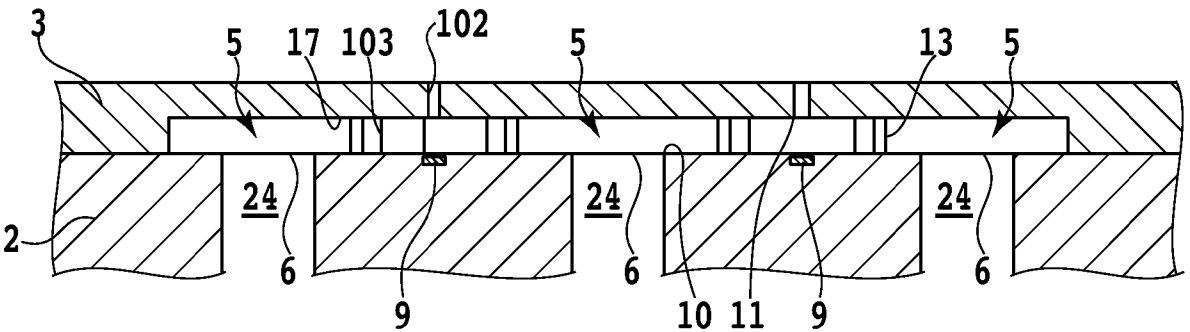
FIG. 10B is a sectional view of the print head taken along line XB-XB in FIG. 10A.
Figure 11A:
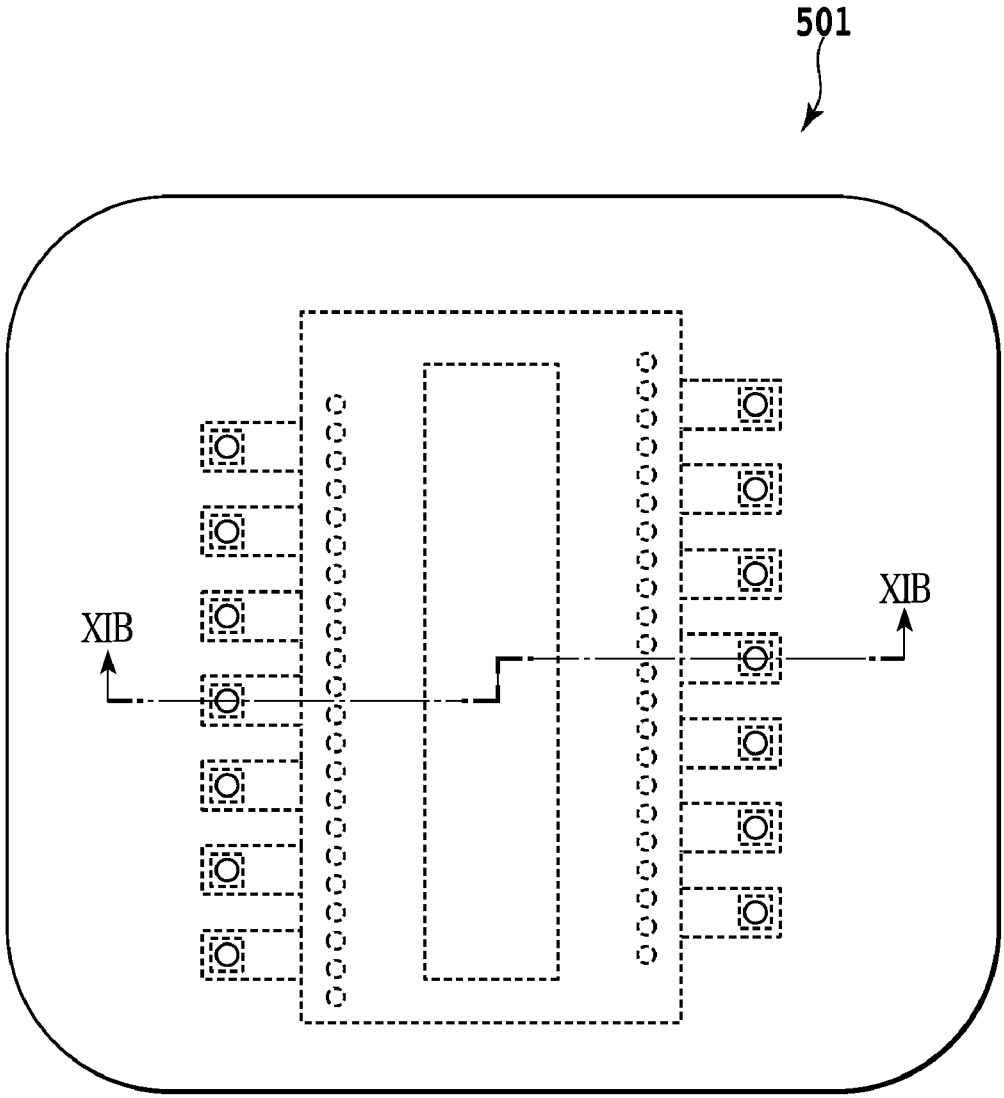
FIG. 11A is a plan view of a conventional print head.
Figure 11B:
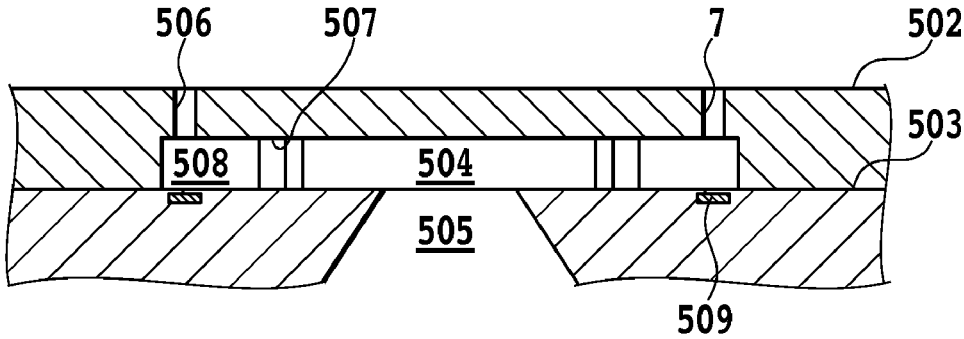
FIG. 11B is a sectional view of the print head taken along line XIB-XIB in FIG. 11A.
Figure 12A:
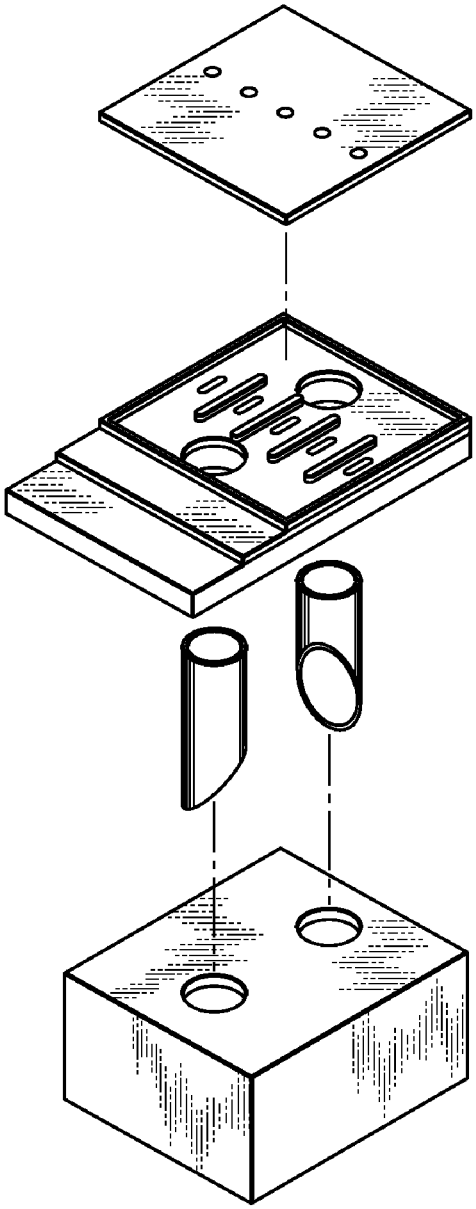
FIG. 12A is a perspective view of components of another example of a conventional print head.
Figure 12B:
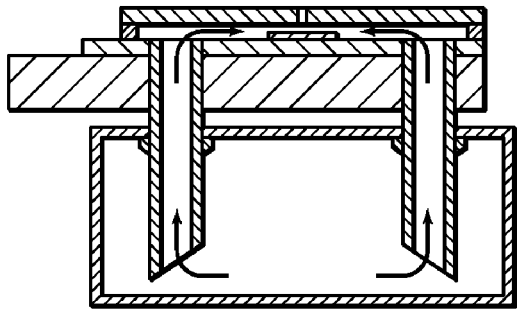
FIG. 12B is a sectional view showing the print head into which the components in FIG. 12A have been assembled.
Figure 13B:
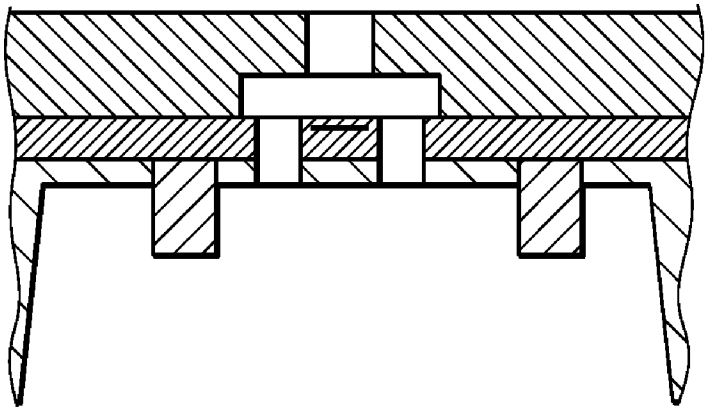
FIG. 13B is a sectional view of the print head in FIG. 13A.
Figure 13A:
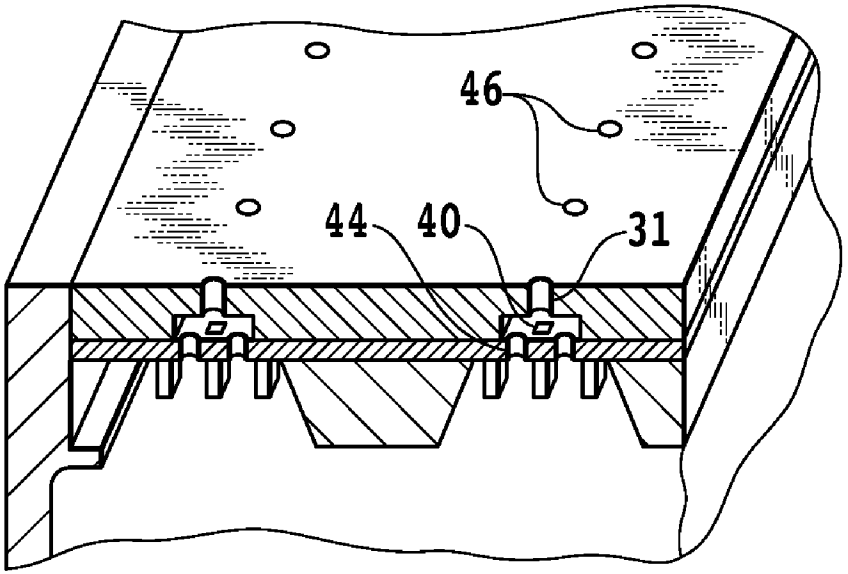
FIG. 13A is a broken perspective view of yet another example of a conventional print head.

FIG. 10A is a plan view of a print head 101 according to the tenth embodiment. FIG. 10B is a sectional view of the print head 101 taken along line XB-XB shown in FIG. 10A.

The print head according to the seventh embodiment has the larger-ejection-amount ejection ports, formed to have the larger diameter, and the smaller-ejection-amount ejection ports, formed to have the smaller diameter; the larger-ejection-amount ejection ports and the smaller-ejection-amount ejection ports are alternately arranged in the direction that the rows of ejection ports extend. The larger-ejection-amount ejection ports and the smaller-ejection-amount ejection ports are partitioned by partition walls between each of the ejection ports, and each of the spaces defined by being sandwiched between the partition walls serves as the pressure chamber. In addition, in the print head 101 according to the present embodiment, some of the plurality of channels 17, corresponding to the respective ejection ports, are one-side supply ink channels 104 each of which is defined as a one-side supply liquid channel so as to be closed on one side thereof and surrounded in three directions. One-side supply intra-ink-channel ejection ports 102 are each formed as a one-side supply intra-liquid-channel ejection port so as to communicate with the corresponding one-side supply ink channel 104. In the present embodiment, the amount of ink ejected through each of the one-side supply intra-ink-channel ejection ports 102, formed in the corresponding one-side supply ink channel 104, is different from that of ink ejected through each of the ejection ports 7, formed in the corresponding channel 17, which is open on the both sides and through which the ink can flow. In the present embodiment, the one-side supply intra-ink-channel ejection port 102 is set to have a smaller diameter and to provide a smaller ink ejection amount than the ejection port 7, formed in the channel 17. In the one-side supply ink channel 104, partition walls 103 sandwiching the one-side supply intra-ink-channel ejection port 102 between the walls 103 are coupled together at one end thereof. Thus, the one-side supply intra-ink-channel ejection port 102 is externally enclosed by the partition walls 103 in the three directions.

As described above, the ejection ports with the smaller ejection amount are unlikely to affect by limitation of the growth of bubbles generated by driving the heaters. Thus, even though the one-side supply intra-ink-channel ejection ports 102 is enclosed by the partition walls 103 in the three directions, the quality of images obtained by ejecting the ink is prevented from being degraded. Thus, the amount of satellites generated falls within an allowable range. Furthermore, since the partition walls 103 are coupled together at one end of the one-side supply intra-ink-channel ejection port 102, a bonding area over which the substrate 2 and the orifice plate 3 are bonded together via the partition walls 103 can be increased. This also increases a support area in which the partition walls 103, located between the substrate 2 and the orifice plate 3, support the substrate 2 and the orifice plate 3. This in turn makes it possible to inhibit the orifice plate 3 from being separated from the substrate 2. Furthermore, since the common liquid chamber 5, which is a relatively large space, is defined between the substrate 2 and the orifice plate 3, the strength of the structure can be improved by supporting parts with relatively low strengths using the partition walls 103. The reliability of the print head 101 can thus be improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-205909, filed Aug. 7, 2007, which is hereby incorporated by reference herein in its entirety.

What is claimed is:

1. A liquid ejection head comprising:

an orifice plate comprising an arrangement of a plurality of ejection ports through which a liquid is ejected;

a substrate comprising an energy generating element generating energy utilized to eject the liquid;

a liquid supply port through which the liquid is supplied to the energy generating element;

pressure chambers each communicating with a corresponding one of the ejection ports and including the energy generating element;

channels each communicating with a corresponding one of the pressure chambers and;

a common liquid chamber communicating with the channels and the liquid supply port, wherein the liquid supplied to the channels through the liquid supply port is ejected in a direction orthogonal to the substrate in conjunction with driving of the energy generating elements, the plurality of channels are each connected to the corresponding pressure chamber at an opposite position with respect to the pressure chamber, the liquid supply port is arranged so as to be located over a range of the row of ejection ports in the direction which the row of ejection ports extends so that the liquid supply port is located at a position corresponding to the plurality of channels along a direction in which the plurality of ejection ports is arranged, and at least one side of each of the plurality of channels is connected to the liquid supply port via the common liquid chamber.

2. The liquid ejection head according to claim 1, wherein at least one side of the liquid supply port connected to the channels arranged opposite the respective pressure chambers is located and divided into a plurality of segments in the direction which the row of the ejection ports extends.

3. The liquid ejection head according to claim 1, wherein the other side of the liquid supply port connected to the channels arranged opposite the respective pressure chambers is located so as to communicate with interior of the channels.

4. The liquid ejection head according to claim 1, wherein the plurality of ejection ports includes larger-ejection-amount ejection ports and smaller-ejection-amount ejection ports, each of the smaller-ejection-amount ejection ports provides a smaller ejection amount than any one of the larger-ejection-amount ejection ports, and the larger-ejection-amount ejection ports and the smaller-ejection-amount ejection ports are alternately arranged.

5. The liquid ejection head according to claim 4, further comprising a channel extending from the common liquid chamber toward an outer periphery of the substrate, arranged in an outer peripheral portion of the substrate, wherein the channel communicates with the smaller-ejection-amount ejection ports.

6. The liquid ejection head according to claim 5, wherein the ejection port communicating with the channel extending from the common liquid chamber toward the outer periphery of the substrate is of a plurality of types providing different liquid ejection amounts.

7. The liquid ejection head according to claim 5, wherein the pressure chamber connected to the channel extending from the common liquid chamber toward the outer periphery of the substrate is defined so as to be enclosed in three directions and not to be enclosed in a connecting portion with the channel.

* * * * *